US005330262A

United States Patent [19]

Peters

[11] Patent Number: 5,330,262

[45] Date of Patent: Jul. 19, 1994

[54] COVED BACKSPLASH FOR A COUNTERTOP

[75] Inventor: Chris R. Peters, Chico, Calif.

[73] Assignee: Transfer Flow International, Inc., Chico, Calif.

[21] Appl. No.: 994,351

[22] Filed: Dec. 21, 1992

[51] Int. Cl.[5] ..... A47B 96/18

[52] U.S. Cl. ..... 312/140.4; 108/27; 4/631; 4/658

[58] Field of Search ..... 4/654, 656, 658, 592, 4/619, 631; 108/27, 48; 52/273, 288, 35; 312/140.1-140.3, 140.4

[56] References Cited

U.S. PATENT DOCUMENTS

| | | | |
|---|---|---|---|
| 2,038,638 | 4/1936 | Brey | 4/656 |
| 2,614,014 | 10/1952 | Stanitz | 4/658 X |
| 2,895,778 | 7/1959 | Lieber | 108/27 |
| 2,970,872 | 2/1961 | Ullmann | 4/658 X |
| 3,359,574 | 12/1967 | Stoneburner | 4/592 |
| 3,606,508 | 9/1971 | Burnes | 108/27 X |
| 3,847,865 | 11/1974 | Duggins . | |

*Primary Examiner*—Charles E. Phillips

[57] ABSTRACT

A backsplash structured to be cooperatively functional with a countertop structure. The backsplash is made of a plastic solid surfacing material, and possesses an integrally formed front bottom lengthwise edge extending outward from and beyond the front face of the backsplash to define a coved lip or flange. The countertop comprises a normally elongated rectangular section of plastic solid surfacing material having an elongated receiving recess. A bottom surface of the backsplash and coved lip is specifically sized and shaped for insertion into the receiving recess of the countertop whereby a curved transition is defined between the top horizontal workspace surface of the countertop and the front face of the backsplash. The bottom surface of the backsplash and coved lip is affixed in place in the receiving recess with the use of a color matching adhesive. Once the adhesive has set, the seam is finished with a light sanding with progressively finer abrasives. Once finished, the durable and easy to clean coved joint between the backsplash and the countertop bears virtually no visible signs of a seam to distract from the appearance of the countertop.

3 Claims, 11 Drawing Sheets

COVED BACKSPLASH FOR A COUNTERTOP

BACKGROUND OF THE INVENTION

1. Field of the Invention

This invention relates to vertically disposed backsplashes separately attached to horizontally disposed countertops such as in kitchens, and more particularly those made of solid plastics having a curved or coved joint at the approximate intersection of the backsplash and countertop. The cove being to provide an aesthetically pleasing and easy to clean intersection between the two members.

2. Description of the Prior Art

Countertops with backsplashes which extend upward for at least a short distance above the countertop are desireable and common. Backsplashes most often are placed against a wall, but sometimes extend vertically upward from the countertop in locations which are not against a wall, to serve to terminate the countertop work space. Countertops and backsplashes made of solid plastics, that is, non-laminated plastic solid surfacing material have become quite popular in recent years in kitchens, bathrooms, and offices of both residential and commercial buildings. The popularity of the use of plastic solid surfacing materials to define countertops and backsplashes is primarily due to the material having the qualities of high durability and ease of damage repair, ease of cleaning and sterilization, and beauty.

Solid surfacing materials as they are known in the plastics industry, are non-foamed, non-laminated polymer based materials, or in short, solid plastics in sheet form useful for defining surfaces. Plastic solid surfacing materials are most often manufactured and sold in sheet form, typically in 30 inch wide×12 foot lengths in thicknesses between ¼ through ¾ inches. Such plastic solid surfacing materials are sometimes referred to by the general public as cultured marble. These polymer based solid surfacing materials are typically manufactured substantially of polyester or acrylic resins, or alloys thereof, depending on the manufacturer, and often contain smaller quantities of other components or additives both natural and synthetic to form desired color, visual pattern designs, and other desirable physical and visual characteristics in the plastics.

Plastic solid surfacing materials are available from several U.S. manufacturers such as E.I. dupont de Nemours & Co., Inc. of Wilmington, Del. 19898 U.S.A., who market their polymer based solid surfacing materials under the trademark of "Corian". "Corian" is a trademark of Du Pont which refers to their solid surfacing polymer based material. "Corian" is a substantially rigid, non-foamed, non-laminated, non-coated solid material composed primarily of acrylic components. "Corian" is most often made and sold in sheet form. U.S. Pat. No. 3,847,865 issued Nov. 12, 1974 to R. B. Duggins and assigned to E.I. dupont de Nemours & Co., teaches one formula for making plastic solid surfacing material of the general nature of that referred to in this disclosure.

Another manufacturer of polymer based solid surfacing material is the Nevamar Corporation located at 8339 Telegraph Rd., Odenton, Md. 21113 U.S.A. The Nevamar Corporation markets their solid surfacing material under the trademark of "Fountainhead". "Fountainhead" is a substantially rigid, non-foamed, non-laminated, non-coated solid material composed of a polymer alloy comprised mostly of polyester components having therein a smaller percentage of acrylic components. "Fountainhead" is most often made and sold in sheet form.

Another manufacturer of polymer based solid surfacing material is the Formica Corporation, located at 155-T Rte. 46, W., CN-980, Wayne, N.J. 07470 U.S.A. The Formica Corporation sells their solid surfacing material under the trademark name of "Surell" "Surell" like "Corian" and "Fountainhead" is a dense solid plastic most often made and sold in sheet form. "Surell" is a substantially rigid, non-foamed, non-laminated, non-coated solid material composed substantially of polyester components.

Du Pont, the Nevamar Corporation, and the Formica Corporation, and several other companies not specifically mentioned, whom produce very similar polymer based solid surfacing materials to one another, manufacture and sell polymer based solid surfacing materials in sheet form intended for use as walling or countertops, and sometimes make and sell cast or heat-formed shapes made of the same polymer based materials useful as kitchen and bathroom lavatories.

Some of the recognized advantages of using polymer based solid surfacing materials such as "Corian", "Fountainhead" or "Surell" over other available materials such as wood, metal, ceramic tile, and high pressure plastic laminates for countertops, exists in the fact that the material is a solid, polymeric non-laminated structure which the color or decorative color patterns extend completely therethrough. If polymer based solid surfacing material does become stained, burned or scratched so deeply that the damage cannot be removed with a common household abrasive cleanser, the damage can be easily removed by light sanding with steel wool or fine sand paper, and this due to the fact that the material is solid, and the color or visual patterns extend completely therethrough. Furthermore, plastic solid surfacing materials typically have a high tensile strength, are quite hard, dense and rigid, and are resistant to chipping, cracking, splitting, warping, burning, and staining, all of which cannot be said about many other materials which could be used as substitutes therefore. Another attractive quality associated with polymer based solid surfacing materials such as those sold under the tradenames of "Corian" "Surell" or "Fountainhead" is the ease of adhesive bonding with available colored glues. Additionally, the polymer based sheets can be easily cut to size or otherwise shaped with mechanical material removal methods and tools using sawing and shaping tools such as router bits, power saws and shapers and the like, similar to those used to cut and shape wood.

Polymer based solid surfacing materials such as "Corian" "Surell" or "Fountainhead" may be manufactured at a relatively low price to very closely resemble texture and visually simulate marble, granite, and other natural stone products which have long been desired and used as building materials due to recognition of the durability and beauty of such natural substances.

It is the above stated qualities and advantages among others which make plastic solid surfacing material a good choice, and an increasingly popular choice for a countertop with backsplash.

Due to excessive costs primarily related to the large number of different available colors from which consumers may now choose, and sizes which would be required to be made, shipped and stocked, countertops of plastic solid surfacing material are not widely manufactured with the backsplashes as integral one piece units. Although plastic solid surface materials have in the past been manufactured as countertops with the backsplashes as integral one piece units by either casting or heat forming, these countertops with integral backsplashes have for the most part been relatively short, narrow, straight lengths generally specifically for bathroom vanities. Due to the significant number of available colors and color patterns of solid surfacing material in sheet form, coupled with the frequent need to custom cut to size and shape countertops and backsplashes, the majority of solid plastic countertops with backsplashes are cut from sheet material and assembled in a countertop fabrication shop or at the installation site. This custom cutting and fabrication of countertops with attached backsplashes is particularly prevalent with kitchens and the like having large amounts of countertop space with the countertops and backsplashes intersecting one another at angles such as 90 degrees.

With countertops having attached backsplashes made of plastic solid surfacing material, one simple prior art system of affixing the backsplash onto the countertop simply involves a butt-joint, which includes adhering the backsplash to the countertop at a right angle, thereby forming a right angled interior corner as may be ascertained from the attached prior art FIG. 1 drawing. The disadvantage of this butt-joint method being that the right angled corner is difficult to keep clean since dirt and water naturally accumulate along the seam, and the sharp angle (90 degrees) of the joint renders it difficult to get a sponge or like cleaning tool into the tight corner. Therefore, a visible joint is rendered more visible with the accumulation of dirt, distracts from the aesthetic appearance of the countertop, and may be unsanitary.

One solution to the difficult to clean right angled joint between the countertop and backsplash is to fashion a radius or coved interior corner joint between the two members which provides much more open space to access with a sponge for cleaning.

A prior art method for creating a radiused or coved interior joint or intersection in plastic solid surface countertops with attached backsplashes, as is illustrated in the attached prior art drawing FIGS. 2A and 2B, is to adhesively affix a rectangular strip of plastic solid surfacing material along the right angled interior corner of the abutted backsplash and countertop, and then mechanically cut to remove a portion of the rectangular strip, such as with a router, leaving a radius or cove between the backsplash and countertop. This process involves utilizing a specialized jig or tool guide for holding the router at a forty-five degree angle to cut the radius. There is little room for error with this procedure, since routing the cove too deep would cut into the backsplash or countertop, and too shallow a cove would require extensive sanding, therefore the installer must be quite skilled in this procedure. This procedure is quite time consuming, requires a high level of skill, and is therefore relatively expensive. Another disadvantage of this type of coved joint is that the longitudinal edges of the cove are quite thin, feathering out to a very thin edge so as to make a smooth transition or blend into the backsplash and countertop without leaving a highly visible seam. These thin feathered edges, particularly the feathered edge which lies in the horizontal plane of the countertop, can result in an area quite susceptible to wear. Even though the thin feathered edges at first may blend in quite well with the backsplash and countertop, they can eventually wear thin with repeated cleaning, particularly with abrasive cleansers. Chipping of the thin edges of the cove can eventually result. The chipped edges leave recesses which accumulate dirt and become harder to keep clean with time. Sometimes the adhesive shows through the chipped thin feathered areas, which is not very aesthetically pleasing when the adhesive is not an exact color match to the material, and the adhesive is seldom an "exact" color match. The showing of the adhesive through the thin feathered edges is particularly noticeable on the feathered edge which lies in the horizontal plane of the countertop because of the angle at which overhead lighting strikes the joint, and not so noticeable with the feathered edge lying in the vertical plane of the backsplash, again, because of the angle at which overhead lighting strikes the seam. As the thin feathered edges wear, more of the adhesive is exposed, and more dirt begins to collect and the joint becomes more visible with time. The problem with wearing of the thin feathered edges is most prevalent with the lower feathered edge which resides in the horizontal plane of the countertop, and not so much with the upper feathered edge residing in the vertical plane of the backsplash.

Another prior art method of creating a coved interior joint or intersection on countertops with attached backsplashes of plastic solid surfacing material, as is illustrated in the attached prior art drawing FIGS. 3A and 3B, is to countersink the lengthwise bottom edge of the backsplash and an edge of an elongated rectangular strip into a rabbet (recess) formed along the upper lengthwise back edge of the countertop. A portion of the rectangular strip is then mechanically removed in the same manner as the first described prior art procedure to define a coved or curved joint. This process also involves utilizing a specialized jig or tool guide for holding the router at a forty-five degree angle. There is also little room for error in the depth of the routing of the cove, and therefore the installer must be quite skilled in this procedure. In this procedure, only the upper edge of the cove lying in the vertical plane of the backsplash is thinly feathered, and this has not been found to be a major problem. However, this method is very time consuming, requires a relatively high level of skill, and is also therefore quite expensive.

It is these shortcomings in countertops with separately attached backsplashes made of plastic solid surfacing material which the present invention overcomes. There is a significant need for an improved system of attaching a backsplash to a countertop made of solid plastics with the resultant joint between the two members being curved or coved for easy cleaning, and one which is reasonably durable, inexpensive, and which the seam(s) is virtually invisible for many years.

SUMMARY

The present invention is a particular backsplash structured to be cooperatively functional with a particular countertop structure. The backsplash in this example of the invention is made of plastic solid surfacing material, and possesses a front lower lengthwise edge extending outward beyond the front face of the backsplash to define a coved lip. The coved lip and backsplash are formed as a single structure from a strip of plastic solid surfacing material while the plastic strip is shaped by cutting blades of a molding machine in a factory manufacturing setting. The countertop in this example of the invention comprises a thin elongated rectangular section of plastic solid surfacing material having an elongated dado or receiving recess most often placed adjacent and parallel to the back lengthwise edge of the countertop. A bottom portion of the coved lip and backsplash is specifically sized and shaped for insertion into the receiving recess of the countertop whereat color matched adhesive specifically approved for the particular plastic, which is initially liquid, is used to permanently affix (bond) the two members together. The bottom surface of the backsplash and coved lip is shaped so as to cooperate with the receiving recess during the affixing process so as to cause hydraulic pressures against the color matched liquid adhesive to force the adhesive to generally flow in a particular direction when the backsplash is pressed against the adhesive and into the receiving recess. The particular direction of the flow of adhesive is toward and out a seam between the countertop and the forward edge of the coved lip of the backsplash so that the seam is completely filled with color matched adhesive, thereby insuring against any unsightly gaps or voids in the seam. This system of insuring a closed seam is important in that the seam lies in the horizontal plane of the exposed work space of the countertop. Once the adhesive has set, the excess adhesive is removed and the seam is finished with a light sanding with progressively finer abrasives such as sandpapers and steelwool. The specific structure of the coved lip of the backsplash, the color matching adhesive and the sanding capabilities of the plastic solid surfacing material, and the recess of the countertop all combine to produce a coved joint at the intersection of the backsplash and countertop having a seam which is normally imperceptible to the human eye. The coved joint made in accordance with the present invention is also much less labor intensive, and requires less skill to create at the job site or fabrication shop, since the difficult hand routing of the radius or cove is eliminated. The forward or front portion of the coved lip of the backsplash which abuts the countertop in the horizontal plane is substantially thick relative to the thin feathered edges common in the prior art, and therefore the connection of the backsplash to the countertop is strong, durable and easy to clean, and possesses no thinly feathered edges lying in the horizontal plane of the countertop through which to show the adhesive or to wear and chip.

BEST MODE FOR CARRYING OUT THE INVENTION

Figure 1:
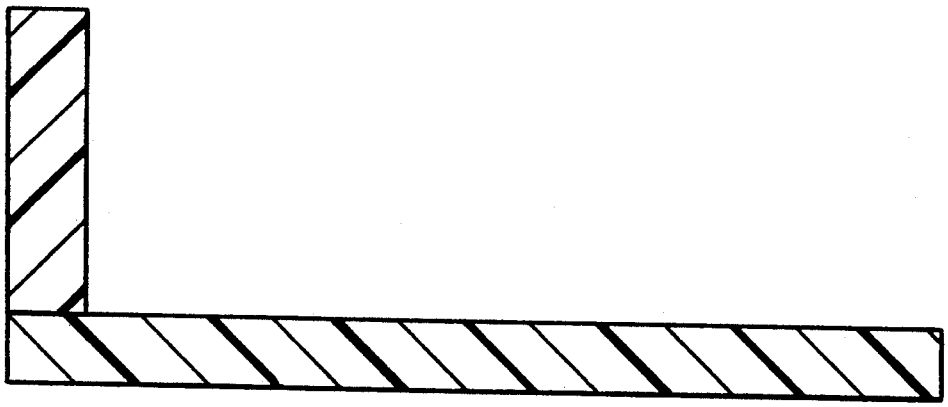
FIG. 1 PRIOR ART
FIG. 1 is a cross sectional side view of prior art illustrating a plastic solid surfacing material backsplash affixed onto a countertop, wherein a right angled interior corner or butt-joint is produced.
Figure 2A:
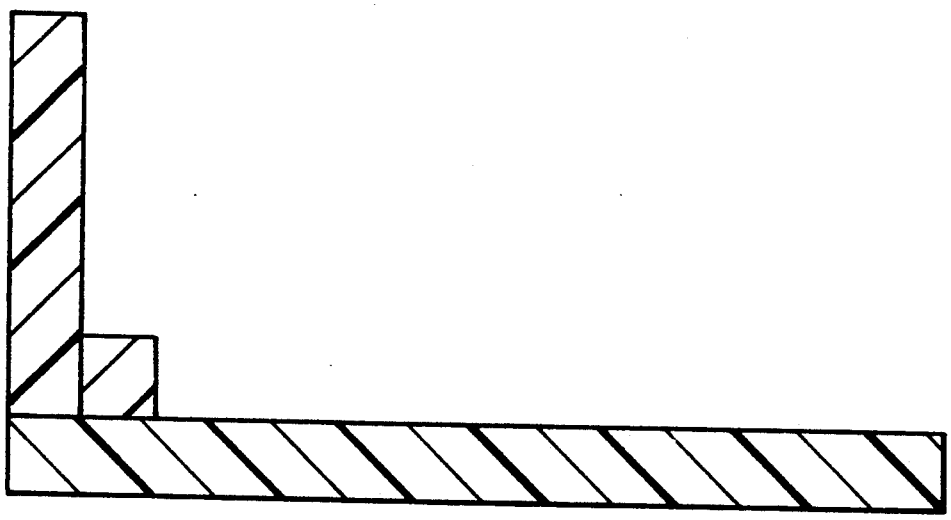
FIG. 2A PRIOR ART
FIG. 2A is a cross sectional side view of prior art illustrating an early step of creating a coved joint in plastic solid surfacing material backsplashes and countertops. The rectangular material strip affixed within the corner is an elongated strip of matching plastic solid surfacing material.
Figure 2B:
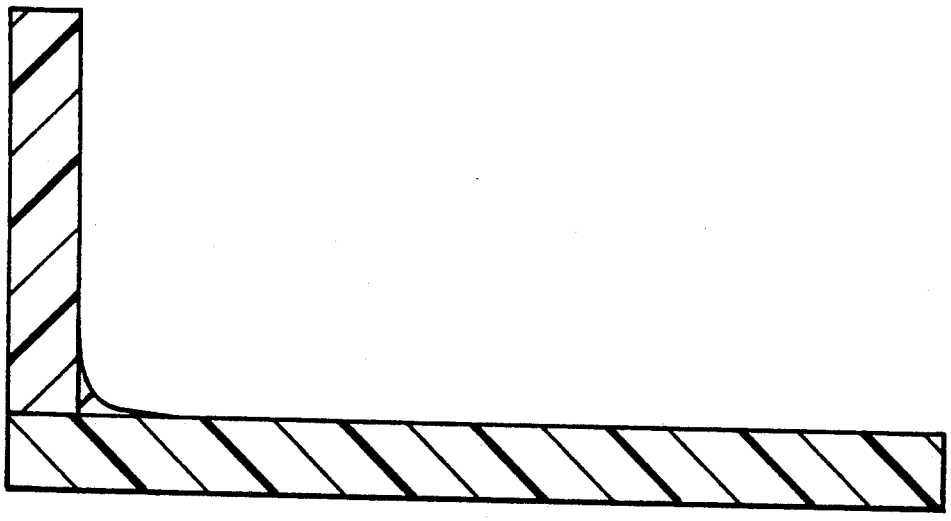
FIG. 2B PRIOR ART
FIG. 2B is a cross sectional side view of the prior art of FIG. 2A after a portion of the rectangular strip has been removed with a hand-held router, resulting in a radius or coved joint.
Figure 3A:
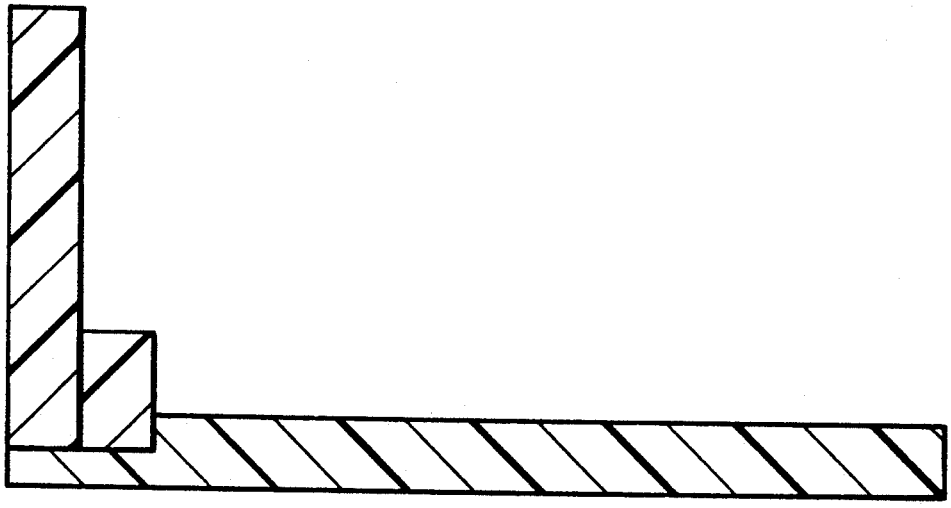
FIG. 3A PRIOR ART
FIG. 3A is a cross sectional side view of another prior art method of creating a coved corner, showing an early step wherein the backsplash and elongated rectangular strip are affixed into a recess or rabbet formed in the edge of the countertop.
Figure 3B:
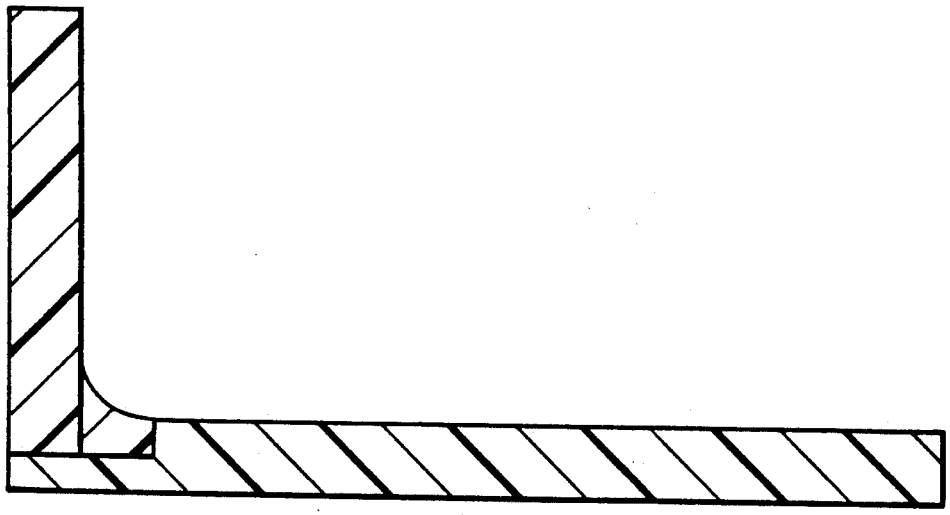
FIG. 3B PRIOR ART
FIG. 3B is a cross sectional side view of the prior art of FIG. 3A depicting the rectangular strip having been routed into a cove. This process has eliminated the thinly feathered edge lying in the horizontal plane.

For the sake of briefness, the detailed description of the present invention in this application is a description of the best mode contemplated and not the only mode contemplated, and therefore must not be viewed in a limiting manner as the only mode for carrying out the invention. Referring now to drawing FIGS. 4 through 12 where the present invention is illustrated in various stages. The present invention includes a particular backsplash 18 structured to be cooperatively functional with a particular countertop 10 structure. Countertop 10 is a thin elongated sheet of plastic solid surfacing material such as that sold under the tradename of "Corian" for example. Countertop 10 can be provided in varying thicknesses and widths, but a typical thickness for a countertop is about ¾ of an inch, and about 30 inches in width for kitchen countertops, with bathroom countertops normally being 19 to 24 inches in width. The length of the countertop is varied to meet the requirements of the desired countertop, and can be any length with splicing with color matched adhesives as a suitable known method of extending available lengths and widths of the plastic sheeting.

A receiving recess 14 is incorporated into the top surface 12 of the countertop 10. Receiving recess 14 is an elongated groove or dado, rectangular in cross section, having straight, flat vertically disposed side walls 13, oppositely disposed from one another, and a flat base or bottom 15. Receiving recess 14 is most often but not always positioned adjacent and parallel to the rear lengthwise edge 16 of countertop 10, best shown in FIG. 4 and 5, so the backsplash 18 after being installed will rest against a wall when the countertop 10 is installed on a countertop support such as a cabinet. This particular structure of receiving recess 14 functions well with the corresponding lower lengthwise coved lip 28 of the backsplash 18 to provide an interlocking seam which effectively distributes the glue to form an extremely stable and secure bond as will be better understood with continued reading. Receiving recess 14 may be cut with a conventional router and dado bit, using a guide fence on the router to ensure a straight dado. Other methods and tools to cut receiving recess 14 could be used, such as with a table saw.

Figure 4:
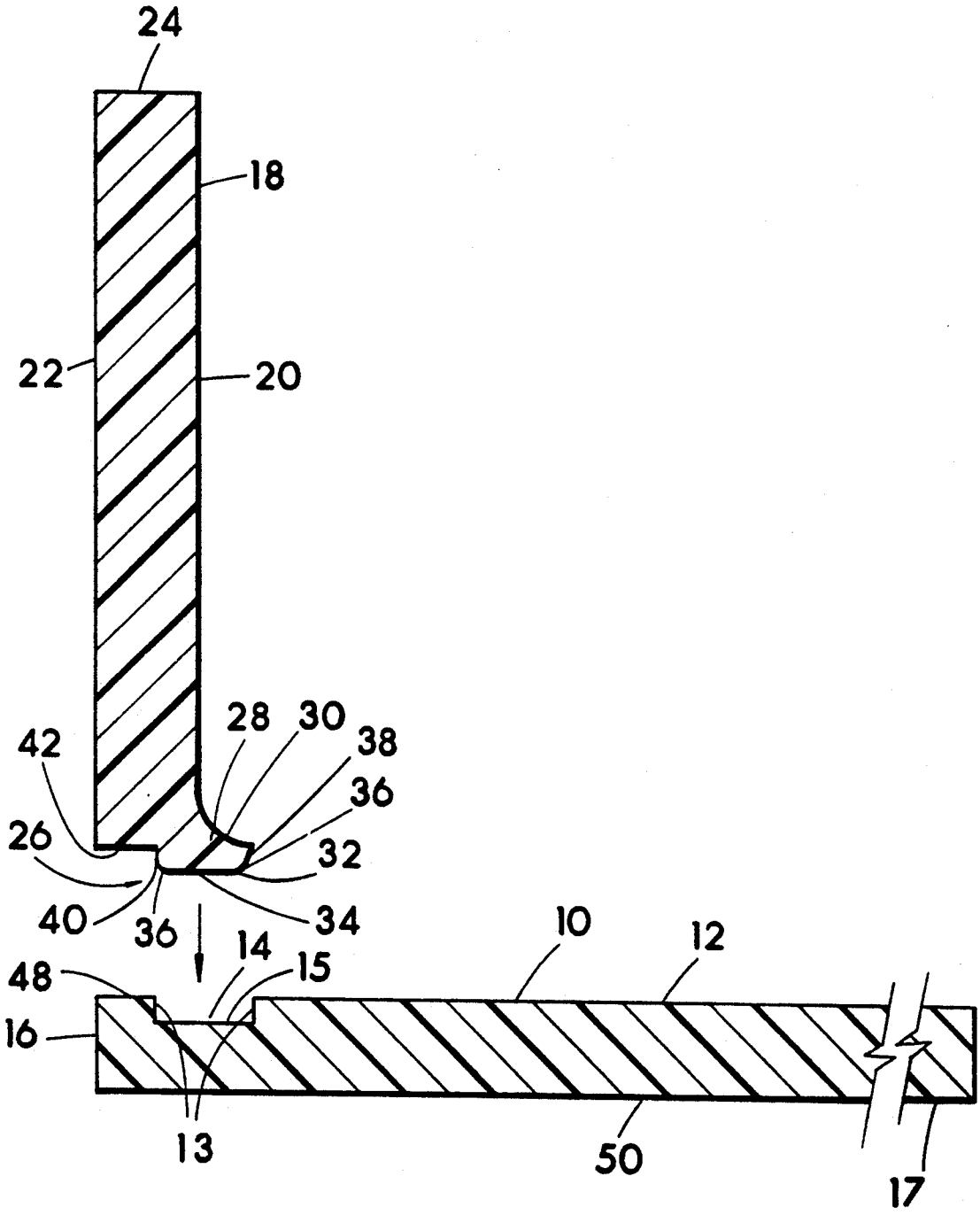
FIG. 4 being in accordance with the present invention, is an exploded cross sectional side view illustrating the coved lip and bottom edge of the backsplash positioned for insertion into the receiving recess (dado) in the countertop.
Figure 5:
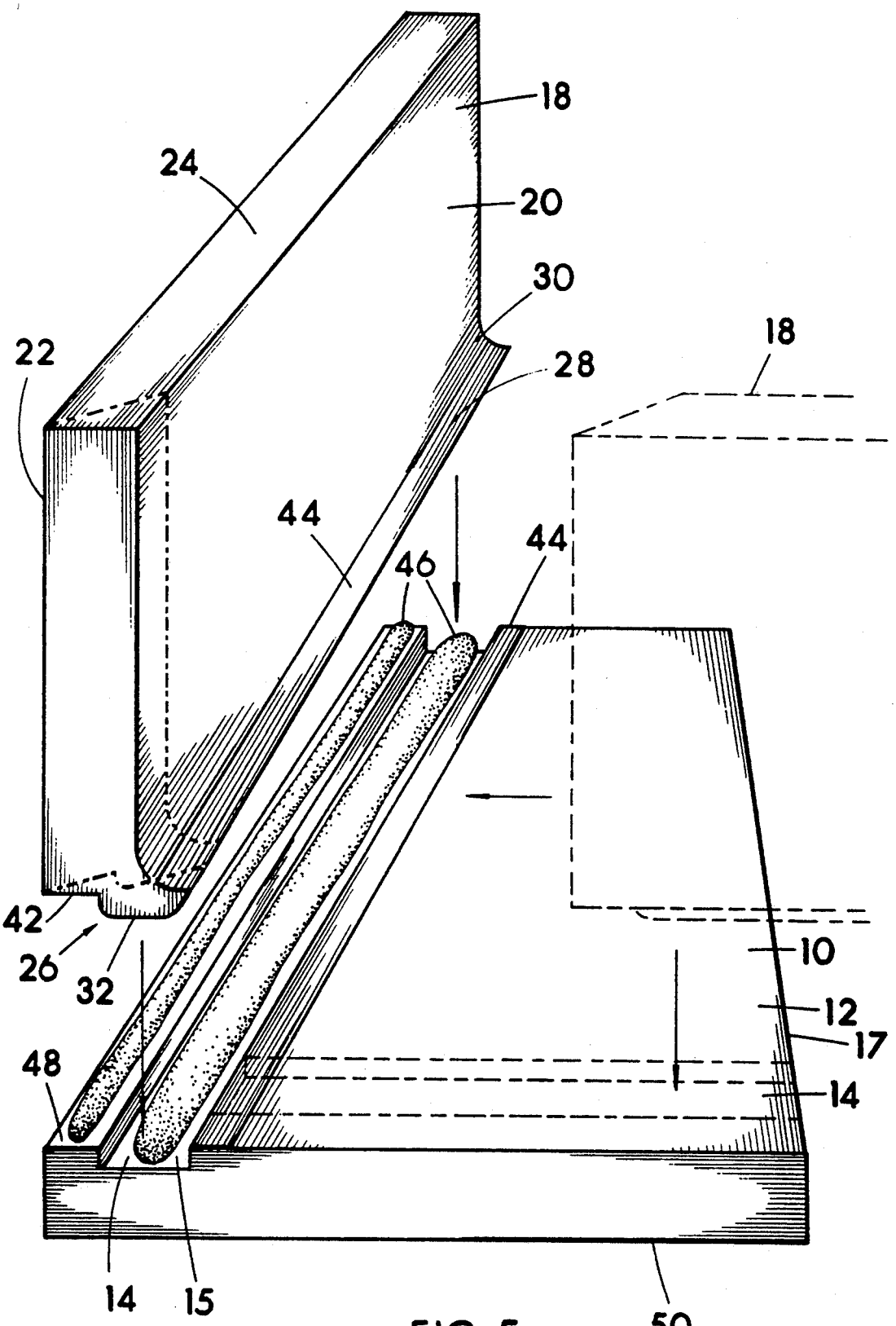
FIG. 5 being in accordance with the present invention, is a top perspective view of the backsplash positioned for insertion into the receiving recess at the back edge of the countertop. The liquid color matched adhesive has been applied in elongated beads. Also illustrated in dotted line is a second receiving recess and backsplash which would intersect the first backsplash at 90 degrees.

Receiving recess 14 may be formed in any area which is to receive a backsplash 18 in accordance with the present invention, and sometimes backsplashes 18 intersect one another at angles such as 90 degrees as is illustratively depicted in FIG. 5. In FIG. 5 a second receiving recess 14 is shown in dotted line in countertop 10 intersecting the shown recess 14 at a 90 degree angle, a situation which normally requires the backsplashes 18 to be cut at 45 degree angles on the ends where they meet one another as is also illustrated in dotted lines. The rear lengthwise edge 16 of countertop 10 will most often abut a wall or cabinet of the building when installed, but this is not always the case such as with island counters. The elongated open top of receiving recess 14 faces upward, being exposed on the top surface 12 of the countertop 10. Receiving recess 14 is preferably a dado as shown in FIG. 4 and described above as opposed to a rabbet type recess or edgeward notch, with this being to eliminate the need to clamp the backsplash 18 forward toward the front edge 17 of countertop 10 to close the seam gap during affixing the backsplash 18 in the receiving recess 14. A rabbet type recess would allow the seam to not fully close unless clamping pressures were also applied in the forward direction, along with the downward clamping pressures which are required with the present invention. By using the dado or rectangular receiving recess 14, only downward clamping pressures need to be applied when affixing the backsplash 18 into receiving recess 14 as will be appreciated with continued reading. One or more ends of countertop 10 may of course be cut at a 45 degree angle to connect to another countertop at 90 degrees as those skilled in the art will readily appreciate. Additionally, the front or forward edge 17 of countertop 10 may if desired be thickened as indicated at 19 in FIG. 9, and as is common where the countertop surface extends off the front edge of a supporting cabinet.

Figure 9:
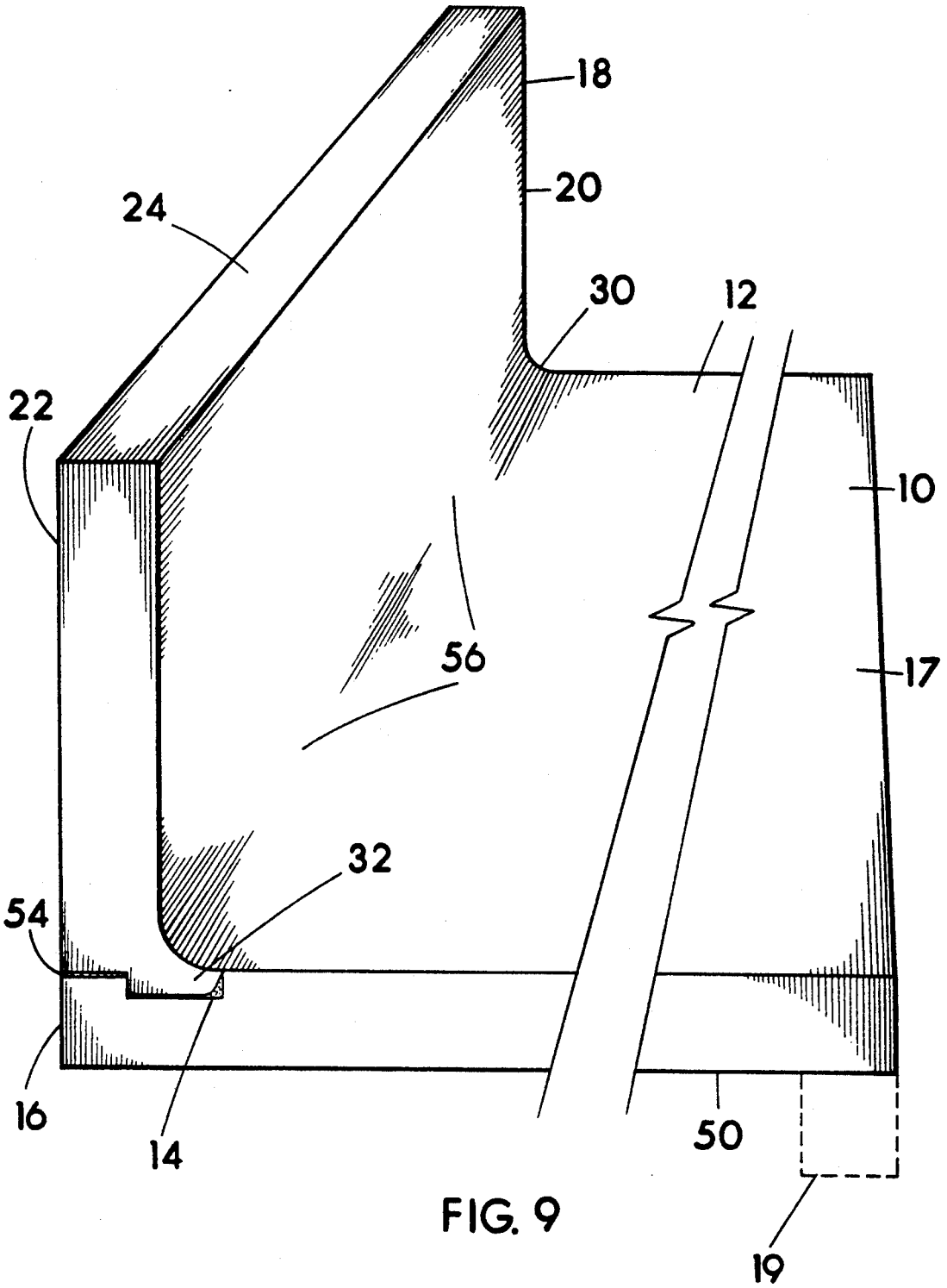
FIG. 9 being in accordance with the present invention, is a top perspective view of the finished countertop with affixed backsplash illustrating the normally imperceptible seam.

Backsplash 18 is an elongated narrow section of plastic solid surface material. Backsplash 18 is normally provided in the same lengths as countertop 10, but since there is not the same weight bearing function as countertop 10, backsplash 18 can be thinner. Since the majority of conventional backsplashes are somewhat standardized in height, backsplash 18 is normally approximately 4 inches in height above the top surface of countertop 10, however, backsplash 18 may be extended in height by using known splicing methods essentially the same as used in splicing countertops to extend the vertical extension of the backsplash above the countertop 10 as high as is desired. When in use backsplash 18 is positioned vertically on edge as is shown in FIG. 9, wherein backsplash 18 includes a broad flat vertical front surface 20, an oppositely disposed broad flat vertical back surface 22, a narrow flat horizontal lengthwise top edge 24 and an elongated bottom edge 26 structured with an outwardly extending coved lip 28 as is shown in FIG. 4. I have considered decoratively sculpturing or shaping the flat front surface 20, however this might render it more difficult to clean.

Coved lip 28 includes an outwardly extending curved or radiused ledge designated cove surface 30 which projects outward from the lengthwise front surface 20 normally about ¼ of an inch. It is the upper surface of coved lip 28 which is radiused as may be seen in the drawings. The bottom surface of the backsplash 18 and coved lip 28 is formed into a foot-shaped flange 32 when viewed from the side as shown in FIG. 4. The bottom of the foot-shaped flange 32 defines a flat horizontal plate 34 approximately two thirds the thickness of backsplash 18. Both ends of horizontal plate 34, when viewed from the side, are curved and are designated roundovers 36. The right roundover 36 connects to an outwardly angled or convex beveled side edge 38. Beveled side edge 38 terminates into the forward distal edge of cove surface 30 or coved lip 28. The left roundover 38 extends vertically upward into vertical side wall 40. The width of flange 32 between side wall 40 and the distal edge of cove surface 30 at beveled side edge 38 is approximately equal to the width of receiving recess 14 as may be ascertained from FIG. 6 and 7. The horizontal plate 34, both roundovers 36, beveled side wall 38, vertical side wall 40, and part of coved surface 30 may be viewed as collectively defining foot-shaped flange 32. Coved lip 28 with foot-shaped flange 32 is extended longitudinally along the full lengthwise bottom edge 26 of backsplash 18. Vertical side wall 40 terminates into a flat horizontal shoulder 42 which is normally about the approximate width of ledge 48 of countertop 10 when it is desired to position the back surface 22 of backsplash 18 aligned with the rear edge 16 of countertop 10, which is common when both surface 22 and edge 16 are to abut a wall.

While countertop 10 can be provided in the finished thickness with the installer easily creating receiving recess 14 prior to installation, the coved lip 28 however is best manufactured into backsplash 18 with the use of specialized milling and shaping equipment prior to distribution to the installer. A further description of the procedures for shaping backsplash 18 with coved lip 28 will be given later in this writing.

Figure 6:
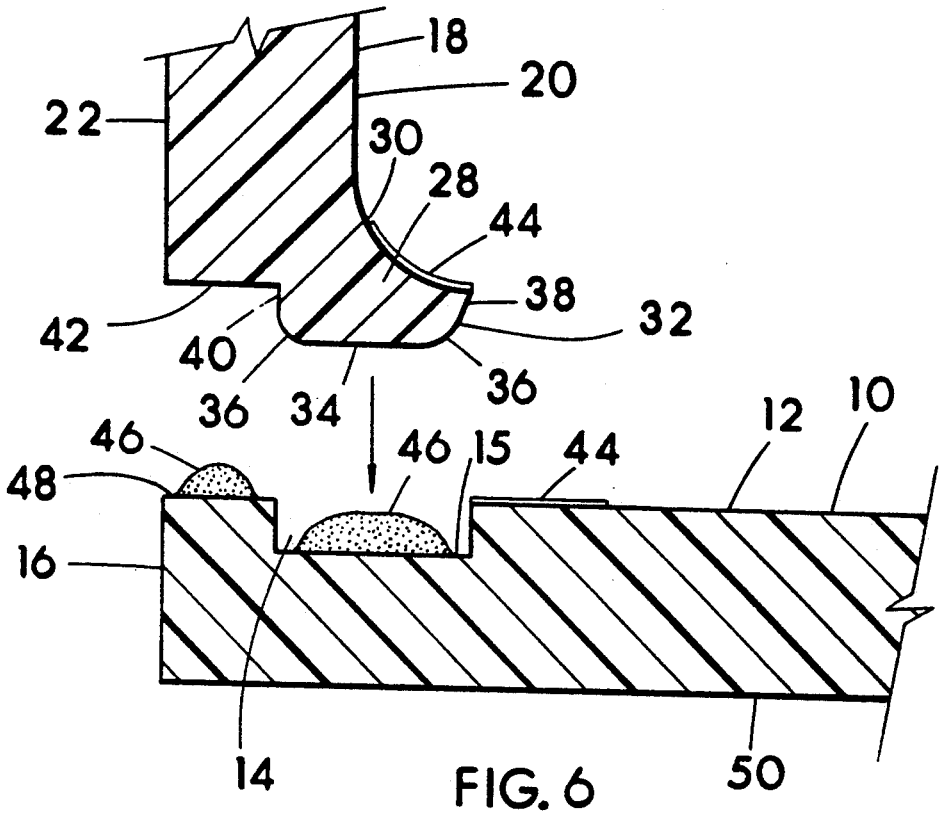
FIG. 6 being in accordance with the present invention, is an enlarged cross sectional side view of the present invention depicting the coved lip of the backsplash positioned above a portion of the countertop showing the adhesive inserted into the receiving recess and rear ledge of the countertop. Masking tape has been applied to both the coved lip and the countertop at the seam line.
Figure 7:
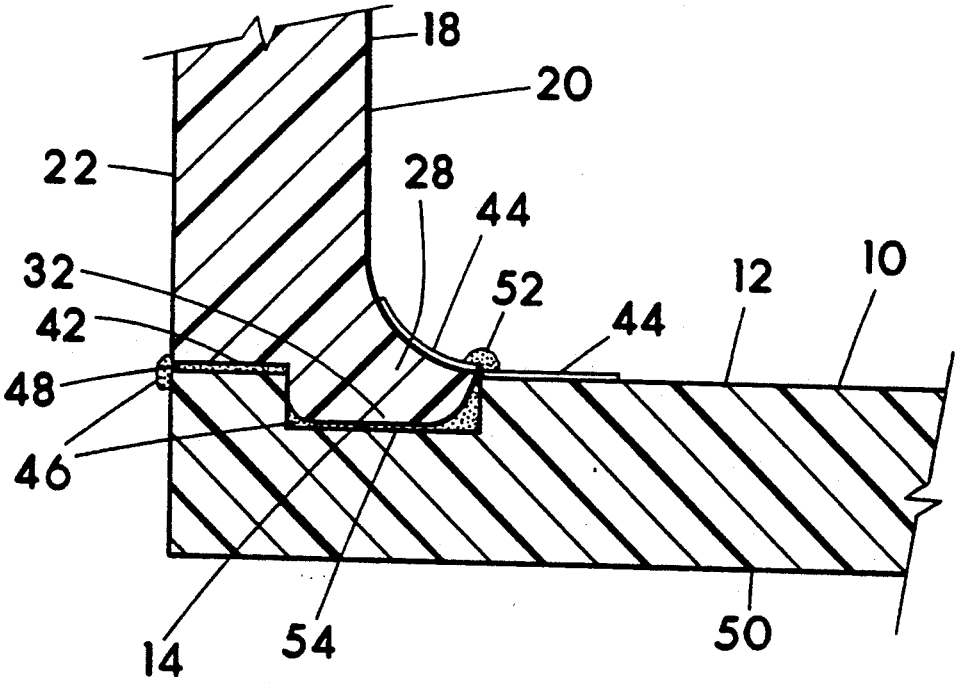
FIG. 7 being in accordance with the present invention, illustrates FIG. 6 after the bottom and coved lip of the backsplash has been inserted into the receiving recess of the countertop. A small bead of adhesive is shown above the seam resting on the masking tape between the cove and countertop. The masking tape renders it much easier and quicker to remove the bead of adhesive.

Prior to affixment of backsplash 18 onto countertop 10, the installer should cut both sections to the correct lengths as specified by the building plans. If the receiving recess 14 is not already incorporated into countertop 10, the installer would create it at this point with a conventional router and dado cutting bit. Masking tape 44 should then be applied to the top surface 12 of countertop 10 along the lengthwise forward edge of receiving recess 14 and along the distal edge of cove surface 30, as shown in FIGS. 5 and 6. Prior to application of the adhesive 46, a denatured alcohol is preferably used to clean receiving recess 14 and foot-shaped flange 32. A liberal amount of color matching liquid adhesive 46 is then applied in a continuous even bead into receiving recess 14 and onto narrow ledge 48 adjacent rear lengthwise edge 16, as shown in FIG. 6. Backsplash 18 is positioned vertically with coved lip 28 aligned with receiving recess 14 and facing forward edge 17 of countertop 10 as is shown in FIG. 9. The foot-shaped flange 32 of coved lip 28 is then inserted into receiving recess 14, with clamps (not shown) such as C-clamps or the like affixed over the bottom surface 50 of countertop 10 and the top edge 24 of backsplash 18, applying vertical pressure to press flange 32 into receiving recess 14. As the vertical pressure is applied, the still liquid adhesive 46 is forced to flow, and due to the size and shape of flange 32 relative to receiving recess 14, the major portion of the flow of the adhesive 46 within recess 14 is toward and up beyond beveled side wall 38 wherein a bead 52 is formed on top of the masking tape 44. The bead 52 ensures the seam being completely full or closed, and the masking tape simply renders it easier to remove the excess glue defining the bead 52 after the adhesive has set. Squaring measures should be taken prior to the adhesive 46 setting to ensure that backsplash 18 is extending perpendicular to the top 12 of countertop 10 as those skilled in the art will appreciate. The depth of receiving recess 14 relative to the downward extension of flange 32 beyond shoulder 42 is or should be such that accounting for about 1/1000 to 4/1000 of an inch of adhesive between bottom 15 of receiving recess 14 and horizontal plate 34 as shown at 54 after clamping pressure has been applied, the distal end of coved surface 30 adjacent beveled surface 38 should be left extending upward about 1/1000 to 4/1000 of an inch above the top surface 12 of countertop 10 when adhesive 46 has hardened. This slight upward extension provides material to sand off to define an imperceptible seam. Once the adhesive 46 has set, masking tape 44 can be removed. The majority of the bead 52 of adhesive 46 will be removed with the peeling away of masking tape 44. To remove the remaining bead 52 of adhesive 46 over seam 56 and to reduce any sections of cove surface 30 extending up above the top surface 12 of countertop 10, a 120 grid sand paper is used over the seam 56 first, followed by 200 grid sand paper. Finally a polishing agent, such as a fine steel wool, is then used to lightly buff the seam 56 so that the shine is even throughout the surface 12 of countertop 10 and backsplash 18. The final result is a seam 56 which is durable and one which normally cannot be detected visually.

The finished assembled unit of backsplash 18 and countertop 10 is then affixed onto the top of the cabinets, preferably with adhesives, although mechanical fasteners may be used. Although not shown in the drawings, the right angled corners of the front lengthwise edge of countertop 10 and the top edge 24 of backsplash 18 can be rounded off with a router for a more conventional appearance if desired. Inlays of differing colors of plastic solid surfacing material may of course also be added to countertop 10 and backsplash 18 if desired for appearance sake.

Figure 8:
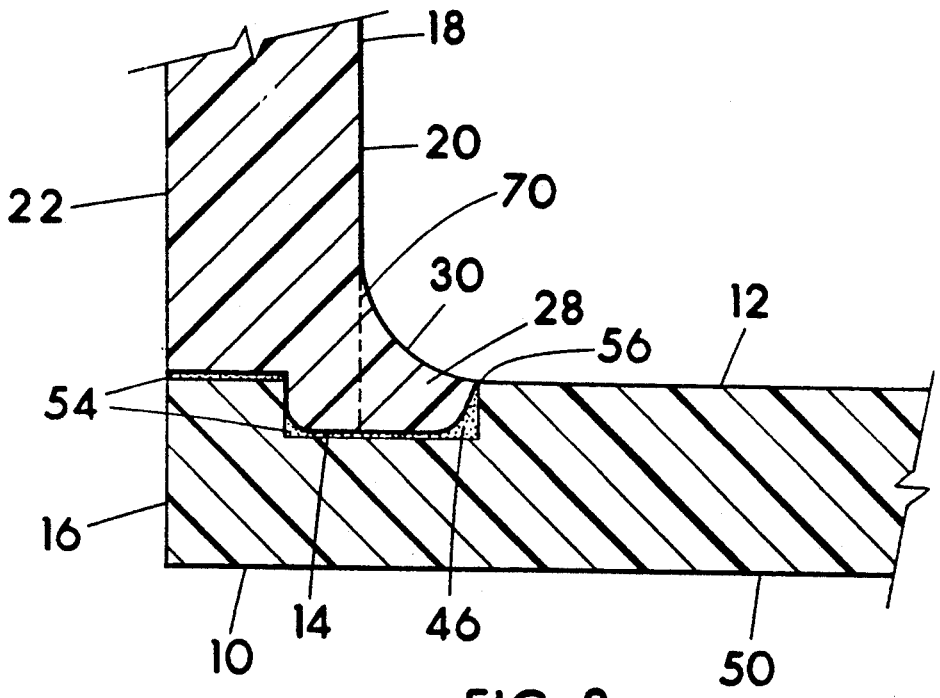
FIG. 8 being in accordance with the present invention, illustrates FIG. 7 after the bead of adhesive and masking tape has been removed.
Figure 10:
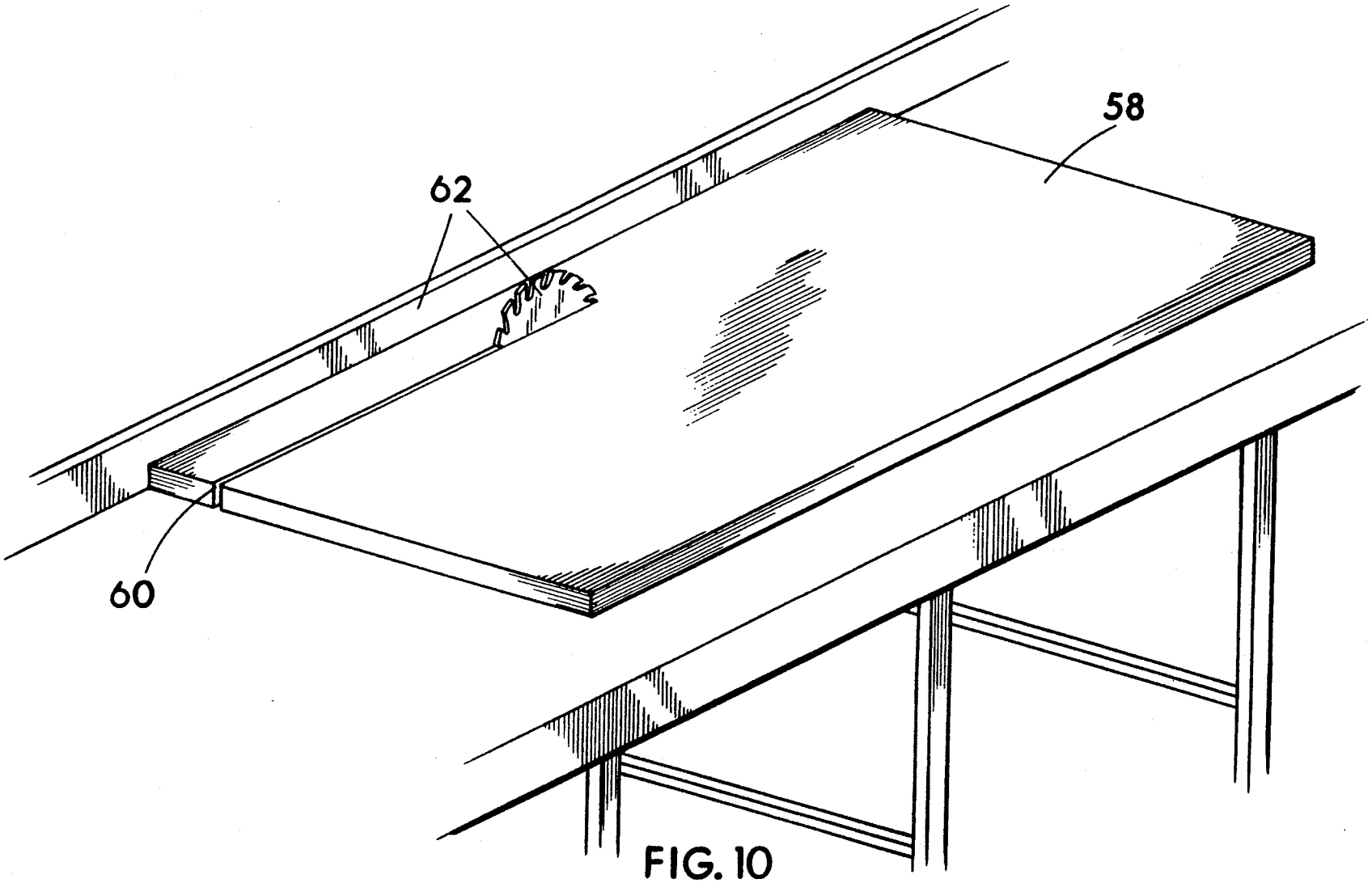
FIG. 10 being in accordance with the present invention, depicts a sheet of plastic solid surfacing material being cut with a table saw into elongated strips as an early step in manufacturing the backsplash.
Figure 11:
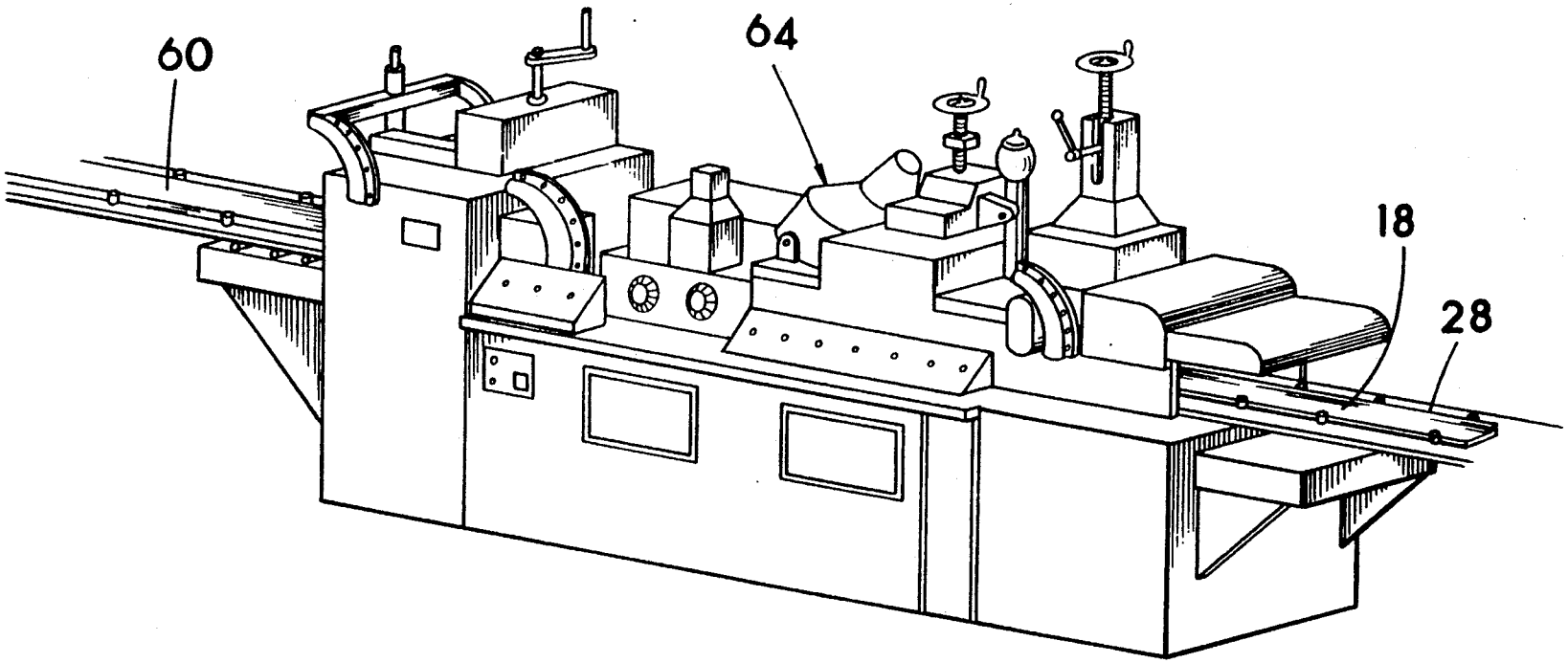
FIG. 11 being in accordance with the present invention, illustrates an elongated strip of plastic solid surfacing material being processed by a molding machine wherein the molding machine mechanically removes portions of the elongated strip to shape and define the backsplash with coved lip.
Figure 12:
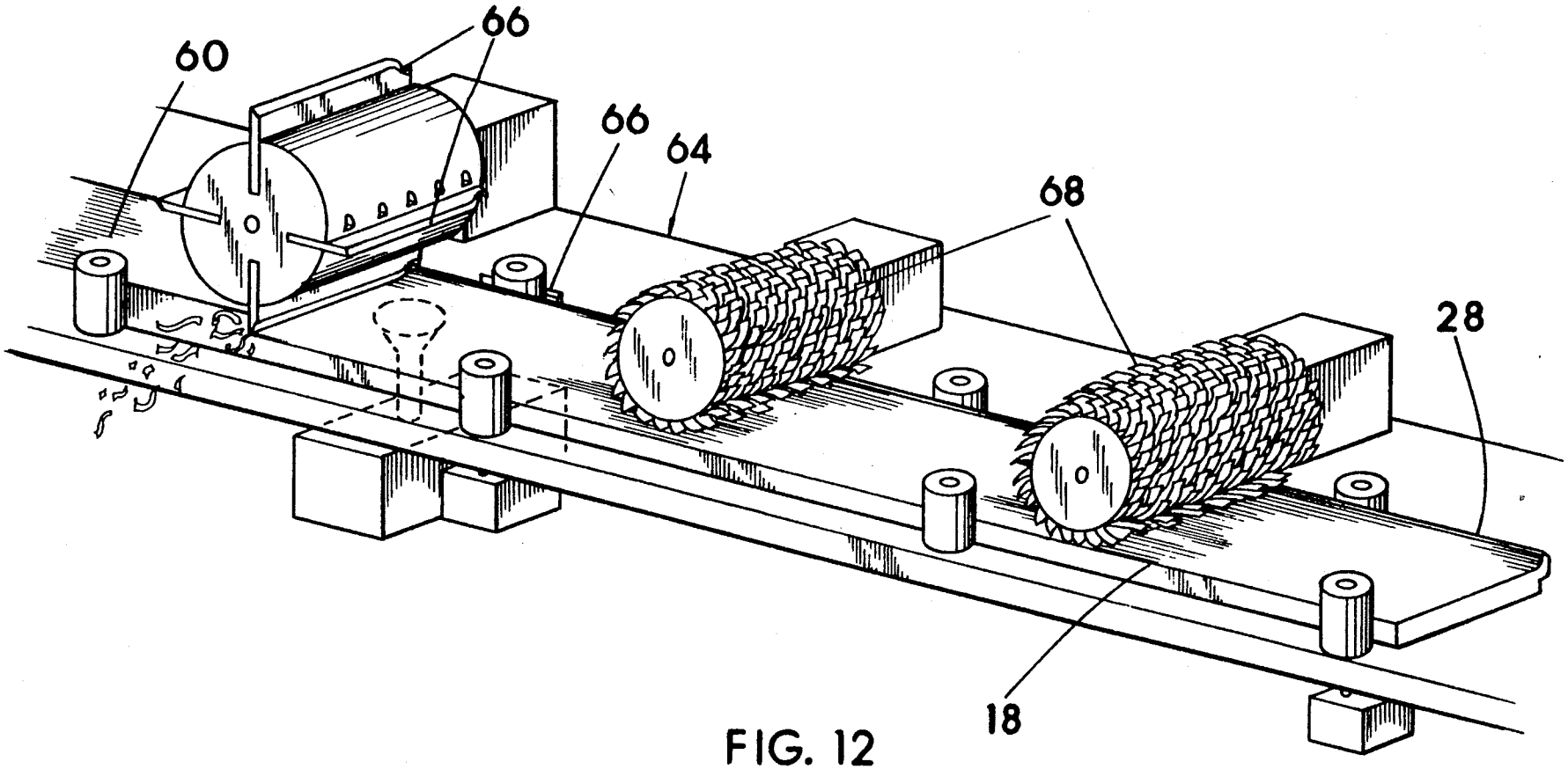
FIG. 12 is a closer illustrative view of the cutters and abrasive wheels of the molding machine as they cut and shape the backsplash with coved lip in accordance with the present invention.

Coved lip 28 is best manufactured into backsplash 18 as an integral component thereof with the use of precision power cutting and milling or shaping equipment in a factory setting which would normally occur prior to distribution to the installer. In FIG. 10, a normally ¾ thick sheet of plastic solid surfacing material 58 is shown being cut into elongated rectangular strips 60 on a table saw 62. The rectangular strip 60 is cut to the approximate 4 inch width as previously discussed for the normal backsplash height. As shown in FIG. 11, a molding machine 64 of the type commonly used for shaping strips of wood into moldings is shown with a strip 60 going into the feed side of the machine 64, and the strip 60 coming out the discharge end of the machine 60 as a backsplash 18 having an integral coved lip 28 and flange 32 in accordance with the invention. FIG. 12 is a closer illustrative view of the rotary cutting heads 66 and the progressively finer abrasive wheels 68 of the molding machine 64 as they cut, shape and sand the strip 60 into the backsplash 18 with coved lip 28 in accordance with the present invention. In FIG. 12 it can be seen that the two cutting heads 66 include multiple cutting blades shaped to cut, by mechanical material removal, the rectangular strip 60 into a backsplash 18 with integrally attached coved lip 28. The two abrasive wheels 68, which the backsplash 18 passes through after being cut by cutting heads 66, sand and polish the newly cut surfaces of the backsplash 18. It should be noted that a few of the available colors of plastic solid surfacing sheet are only available in maximum thicknesses of ½ inch of less, which normally is not sufficient to form an integral coved lip 28. In this situation, the rather thin elongated strip 60 would receive an elongated rectangular strip of the same plastic affixed by color matched adhesive prior to being passed through the molding machine 64. The elongated attached strip would be attached in the area which the molder 64 will cut to define the coved lip 28. In FIG. 8, dotted line 70 represents the seam of an elongated attached strip which has been shaped into coved lip 28.

It should be noted that although the description thus far has been centered around the backsplash 18 and countertop 10 both being made of plastic solid surfacing material, it is believed either backsplash 18, countertop 10 or both could be made of other materials such as wood and still be within the scope of the present invention. Additionally I believe the bottom side of coved lip 28 and the adjacent bottom of the backsplash 18 could possibly be flat, eliminating the foot-shaped flange 32, and still function fairly adequately.

Although I have very specifically described the preferred structures and best modes of the present invention, it should be understood that the specific details are just that, "preferred" and "best" given for example to those skilled in the art. Changes in the specifics described may be made without departing from the true scope of the invention, and therefore it should be understood that the scope of the invention is not to be overly limited by the specification and drawings given for example, but is to be determined by the spirit and scope of the appended claims.

What I claim as my invention is:

1. A backsplash (18) with coved lip (28), said backsplash (18) and coved lip (28) made of plastic solid surfacing material and structured for attachment into a dado in a top surface of a countertop made of plastic solid surfacing material to define a coved intersection between said backsplash (18) and the countertop in the creation of a non-laminated plastic solid surfacing material combination countertop with backsplash (18) wherein a joint at the coved intersection between said backsplash (18) and a horizontal workspace surface of the countertop is a tightly closed and virtually imperceptible joint, said backsplash (18) being an elongated generally rectangular structure having a narrow top edge (24) and an oppositely disposed narrow horizontally disposed bottom edge (42), said horizontally disposed bottom edge (42) of said backsplash (18) for resting on a surface of the countertop immediately adjacent the dado, said backsplash (18) further having a relatively wide vertically oriented back surface (22) extending between said top and bottom edges (24, 42), and a relatively wide vertically oriented front surface (20) extending between said top and bottom edges (24, 42) and oppositely disposed from said back surface (22) of said backsplash (18), and backsplash (18) further having said coved lip (28) extending outward beyond said front surface (20) of said backsplash (18) and terminating in a front terminal edge with said coved lip (28) extending generally fully along a front bottom lengthwise edge of said backsplash (18), a bottom surface (34) of said coved lip (28) having a generally horizontally disposed plane for placement said gluing within the dado in the countertop, said lip having a vertically oriented side wall (40) defined between said horizontally disposed bottom edge (42) of said backsplash (18) and said bottom surface (34) of said coved lip (28) for abutting a vertically oriented side wall of the dado and thereby properly positioning said front terminal edge of said coved lip (28) relative to the dado, said lip having a convex surface extending from a point on said bottom surface to said front terminal edge, said coved lip (28) including an upper radius (30) extending from said front terminal edge to said front surface (20) of said backsplash (18) for defining a coved interface between said backsplash (18) and the countertop, said coved lip (28) being approximately equal in cross-sectional width between said vertically oriented side wall (40) on said backsplash (18) and said front terminal edge of said coved lip (28) as a cross-sectional width of the dado.

2. The backsplash of claim 1 further in combination with a counter top defining a horizontal surface and having a dado near one edge thereof to accept said lip, said dado having a first and second vertically oriented sidewall on either side of a bottom surface defining at least one corner between said first side wall and said bottom.

3. The combination of claim 2 further including affixing said backsplash within said dado by application of an adhesive to the bottom surface of said dado wherein said coved lip is sized and shaped relative to said dado so that with said horizontally disposed bottom edge of said backsplash resting on said top surface of said countertop immediately adjacent said dado simultaneously with said bottom surface of said coved lip placed within said dado, at least a portion of said convex surface is tightly abutted against said second vertically oriented side wall of said dado whereat the tightly abutted convex surface is abutted in such a position as to leave said forward most terminal edge of said coved lip positioned extending slightly upward above said top surface of said countertop and extending slightly upward forward over an intersection of said top surface with said second vertically oriented side wall of said dado due to a level of said top surface of said countertop, said convex surface serves as a hydraulic press in combination with said corner in said dado to press against said supply of liquid adhesive causing said adhesive to move upward and fill voids between said convex surface and said second vertically oriented side wall of said dado, further including abrasively removing the upward extending portion of said forward most terminal edge using progressively finer sanding means so as to being downward the extending portion of said forward most terminal edge to a level equal to said top surface of said countertop and to thus render a tightly closed and virtually imperceptible joint at said coved intersection between said countertop and said backsplash.

* * * * *